US006363232B1

(12) United States Patent
Flaherty

(10) Patent No.: US 6,363,232 B1
(45) Date of Patent: Mar. 26, 2002

(54) DEVELOPER MATERIAL CARTRIDGE HAVING A ROBUST MULTIPLE FUNCTION SEAL

(75) Inventor: Daniel M. Flaherty, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/684,939

(22) Filed: Oct. 10, 2000

(51) Int. Cl.[7] ..... G03G 15/08

(52) U.S. Cl. ..... 399/106; 399/262; 222/541.6; 220/266

(58) Field of Search ..... 399/106, 262, 399/263; 222/DIG. 1, 162, 167, 172, 541.1, 541.2, 541.6, 541.7; 220/265, 266, 277

(56) References Cited

U.S. PATENT DOCUMENTS 3,425,598 A * 2/1969 Kobernick
4,561,567 A * 12/1985 Wittstein et al. ..... 222/83.5
5,472,112 A * 12/1995 Maciejewski ..... 220/745
5,495,323 A 2/1996 Meetze, Jr.
5,576,816 A 11/1996 Staudt et al.
5,678,121 A 10/1997 Meetze, Jr., et al. ..... 399/12
5,740,506 A * 4/1998 Sundquist et al. ..... 399/262
5,995,788 A * 11/1999 Baek ..... 399/238
6,137,972 A * 10/2000 Playfair et al. ..... 399/106

* cited by examiner

*Primary Examiner*—Robert Beatty
(74) *Attorney, Agent, or Firm*—Tallam I. Nguti

(57) ABSTRACT

A developer material cartridge including a robust multiple function seal, for use in a developer unit of an electrostatographic reproduction machine including a machine interface member. The developer material cartridge includes a cylindrical housing defining a developer material containing chamber and an open end into the chamber. The robust multiple function seal comprises a single member including a solid first end for sealing the open end into the developer material containing chamber during shipping and transportation of the cartridge. The single member also includes a partially slit-through second end and lead in recess for enabling non-damaging coupling with, as well as puncturing of the solid first end by, the machine interface member, thereby avoiding the undesirable risks of seal damage and developer material spills.

9 Claims, 5 Drawing Sheets

DEVELOPER MATERIAL CARTRIDGE HAVING A ROBUST MULTIPLE FUNCTION SEAL

BACKGROUND OF THE INVENTION

The present invention relates to a developer apparatus of an electrostatographic reproduction machine, and more particularly to a developer material cartridge having a robust multiple function seal.

Reproduction machines such as copiers and reproduction machines typically employ the art or process of xerography. The art or process of xerography involves forming electrostatic latent images on a surface by first uniformly charging a photoreceptor. The photoreceptor comprises a charge retentive surface. The charge is image-wise selectively dissipated in accordance with an image pattern of activating radiation corresponding to an original image. The selective dissipation of the charge leaves a latent charge pattern on the imaging surface corresponding to the areas not exposed by radiation.

This charge pattern is then developed, or made visible with toner using a development apparatus or unit containing developer material such as single component, or toner and other components including carrier particles. The toner is generally a colored powder which is charged and adheres to the charge pattern by electrostatic attraction resulting in a toner developed image. The toner developed image is then fixed to the imaging surface or is transferred to a receiving substrate such as plain paper to which it is thereafter fixed by suitable fusing techniques.

Black and white toner images can be formed by the process as described above, and multicolor toner images can be similarly formed by using not just one but several development units containing different colors of toner. Such multicolor toner images can be highlight color images or full color images. One approach for forming such toner images is in a single pass of the photoreceptor during which color separation toner images are formed in registration, one on another, or in what is called an "image-on-image" manner. In the above processes, as toner within the developer material in the development apparatus is transferred to the photoreceptor and eventually to the copy paper, toner is used is used up or depleted, and must therefore be replaced. The electrostatographic reproduction machine as disclosed for example in commonly assigned U.S. Pat. No. 5,678,121 issued Oct. 14, 1997, thus includes a toner container or cartridge from which fresh toner is dispensed into the machine.

Some of such toner containers or cartridges, as disclosed for example in commonly assigned U.S. Pat. No. 5,495,323, are cylindrical and have spiral ribs located therein, which when rotated urge the toner to the end thereof. These containers have an opening in the periphery of the container near one end thereof through which toner escapes. A machine interface which must be sealed to the container is used to remove toner from the opening. Typically the dispensing hole is covered with a slit-through robust multiple function seal and a secondary seal or plug 816 for retaining the toner during shipment and installation, as disclosed for example in commonly assigned U.S. Pat. No. 5,576,816. The secondary seal or plug is also required because with only a conventional robust multiple function seal, there is a continued risk of damaging the seal during puncturing thus resulting in dirty surfaces at the opening and interface, as well as a risk of toner spilling if the container is tipped during installation. In addition, the required secondary seal or plug, which must remain inside the cartridge during operation of the cartridge, is costly and can be operationally undesirable.

There is therefore a need for a less costly way of sealing such a developer material cartridge for operation without the continued risk of damaging the seal during puncturing thus resulting in dirty surfaces at the opening and interface, as well as toner spilling if the container is tipped during installation.

SUMMARY OF THE INVENTION

According to the present invention, there is provided a developer material cartridge including a robust multiple function seal, for use in a developer unit of an electrostatographic reproduction machine including a machine interface member. The developer material cartridge includes a cylindrical housing defining a developer material containing chamber and an open end into the chamber. The robust multiple function seal comprises a single member including a solid first end for sealing the open end into the developer material containing chamber during shipping and transportation of the cartridge. The single member also includes a partially slit-through second end for enabling non-damaging coupling with, and puncturing of the solid first end by, the machine interface member, thereby avoiding the undesirable risks of seal damage and developer material spills.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrostatographic reproduction is well known, the various processing stations employed in the FIG. 1 electrostatographic reproduction machine will be shown hereinafter schematically and their operation described briefly with reference thereto.

Figure 1:
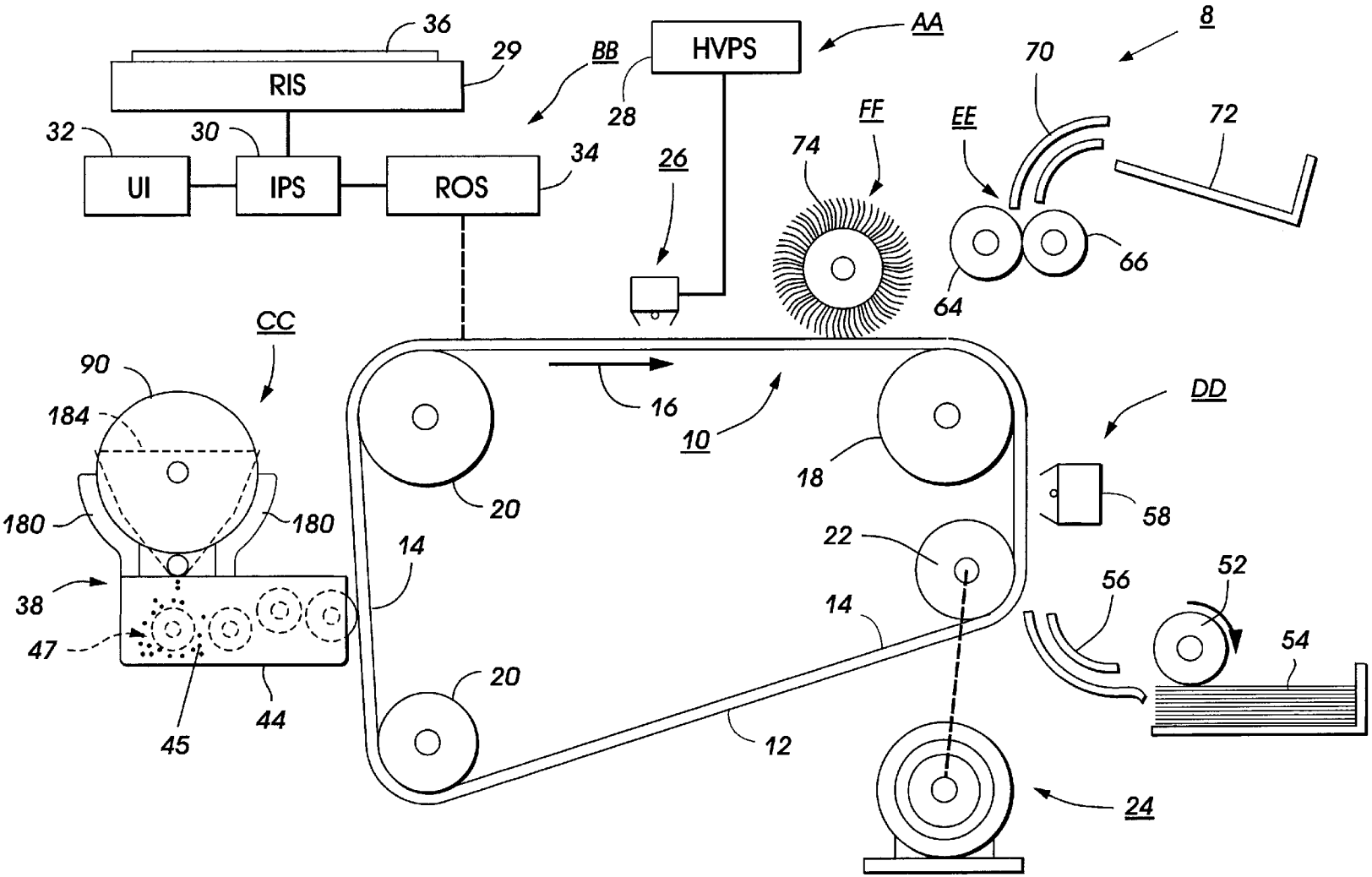
FIG. 1 is a schematic elevational view of an illustrative electrostatographic reproduction machine having a developer unit incorporating the developer material cartridge and robust multiple function seal of the present invention.

Referring initially to FIG. 1, there is shown an illustrative electrostatographic reproduction machine 8 having a developer unit 38 incorporating the developer material cartridge 90 including the robust multiple function seal of the present invention (to be described in detail below). As shown, the electrostatographic reproduction machine 8 includes a photoreceptor 10 in the form of a belt having a photoconductive surface layer 12 on an electroconductive substrate 14. Preferably the surface 12 is made from a selenium alloy and the substrate 14 is made from an aluminum alloy which is electrically grounded. The belt is driven by means of motor 24 along a path defined by rollers 18, 20 and 22, in the direction of arrow 16.

Initially a portion of the belt 10 passes through a charge station AA at which a corona generator 26 charges surface 12 to a relatively high, substantially uniform, potential. A high voltage power supply 28 is coupled to device 26. Next, the charged portion of photoconductive surface 12 is advanced through exposure station BB where an original document 36 is positioned on a raster input scanner (RIS) 29. The RIS 29 captures the entire original document and converts it to a series of raster scan lines and (for color printing) measures a set of primary color densities, i.e., red, green and blue densities at each point of the original document. This information is transmitted to an image processing system (IPS) 30 that is the control electronics which prepare and manage the image data flow to raster output scanner (ROS) 34.

A user interface (UI) 32 is in communication with the IPS 30 and thus enables the operator to control the various operator adjustable functions of the machine 8. ROS 34 lays out the image in a series of horizontal scan lines with each line having a specified number of pixels per inch. The ROS 34 as is known, includes a laser having a rotating polygon mirror block associated therewith, and functions to expose the charged photoconductive surface 12 of the photoreceptor 10, thus recording on the surface 12, an electrostatic latent image of the original image.

After the electrostatic latent image has been recorded on photoconductive surface 12, belt 10 advances the latent image to development station CC as shown in FIG. 1. At development station CC, the developer unit 38 (incorporating the developer material cartridge 90 including the robust multiple function seal of the present invention) develops the latent image into a visible toner image. As illustrated, developer unit 38 includes a housing 44 that defines a sump 45 which stores developer material 47. The developer material 47 may be a single component material such as toner particles alone, or it equally can be a two component developer material of at least magnetic carrier granules and toner particles adhering triboelectrically thereto. As shown, the developer material cartridge 90 of the present invention is installed in developer unit 38 above the sump 45, by means of cartridge supports 180.

Still referring to FIG. 1, after the electrostatic latent image has been developed thus at development station CC, belt 10 advances it to transfer station DD where a copy sheet 54 is advanced, for example, by a roll 52 and guides 56 into contact with the developed image on belt 10. A corona generator 58 is used to spray ions onto the back of the sheet 54 so as to attract the toner image from belt 10 onto the sheet. The sheet 54 with the toner image thereon is then stripped from the belt 10 as the belt turns around roller 18.

After toner image transfer as such, the sheet 54 and toner image thereon are advanced by a conveyor (not shown) to fusing station EE. Fusing station EE includes a heated fuser roller 64 and a back-up roller 66 forming a fusing nip as shown. The sheet passes through the fusing nip with the toner image contacting the heated fuser roller 64. In this way, the toner powder image is permanently affixed to the sheet. After fusing, the sheet advances through chute 70 to catch tray 72 for subsequent removal from the electrostatographic reproduction machine 8 by the operator.

Meanwhile, after the sheet 54 was stripped from the belt 10 as above, residual toner particles remaining on the photoconductive surface 12 of belt 10 are subsequently removed therefrom at cleaning station FF by cleaning device. For example, a rotatably mounted fibrous brush 74 mounted in contact with photoconductive surface 12 can be used. Following such cleaning, a discharge lamp (not shown) may flood photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrostatographic reproduction machine and the developer unit 38, incorporating the developer material cartridge 90 and robust multiple function seal of the present invention.

Figure 2:
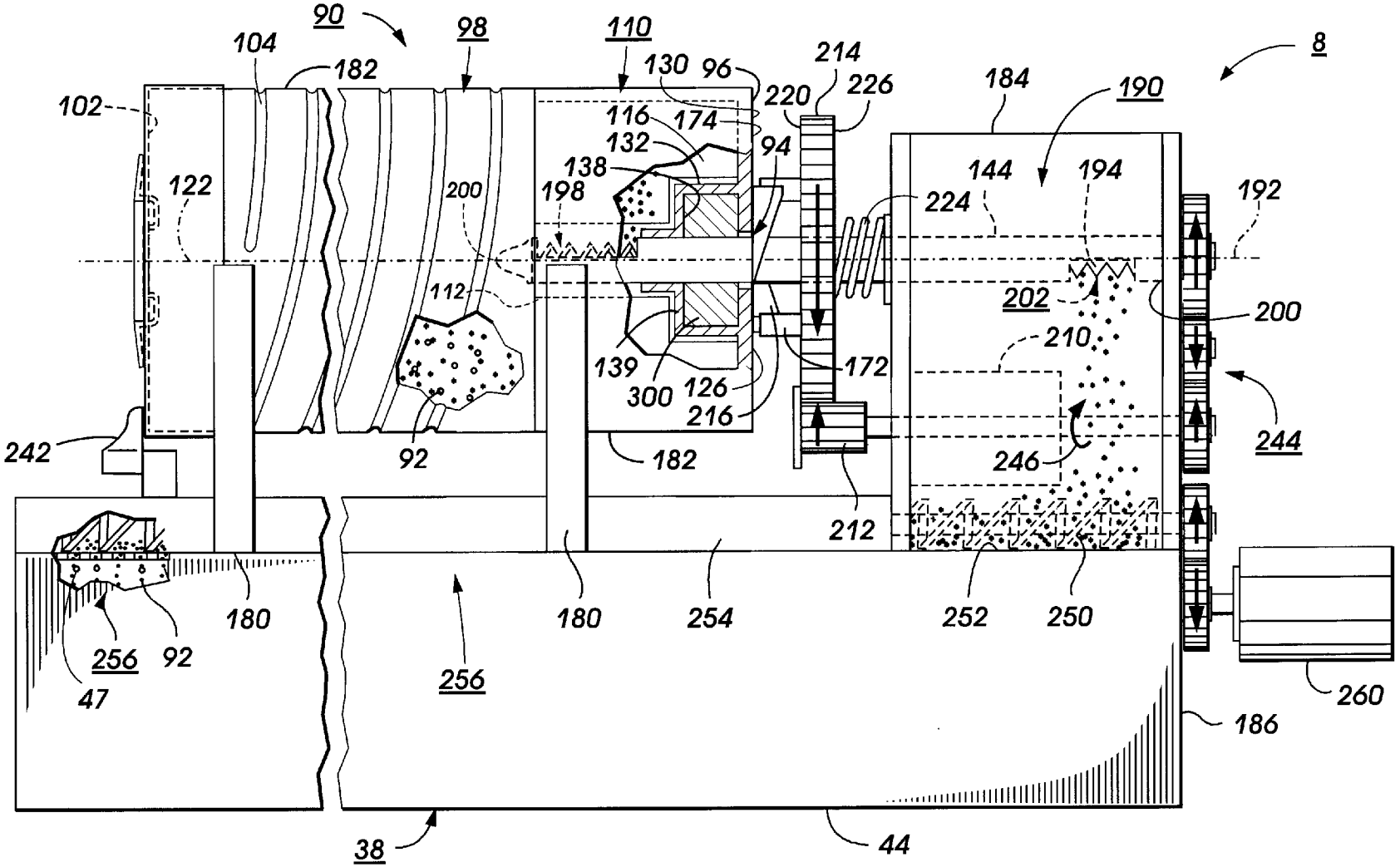
FIG. 2 is a plan view showing the developer unit of FIG. 1 incorporating the developer material cartridge and robust multiple function seal of the present invention.
Figure 3:
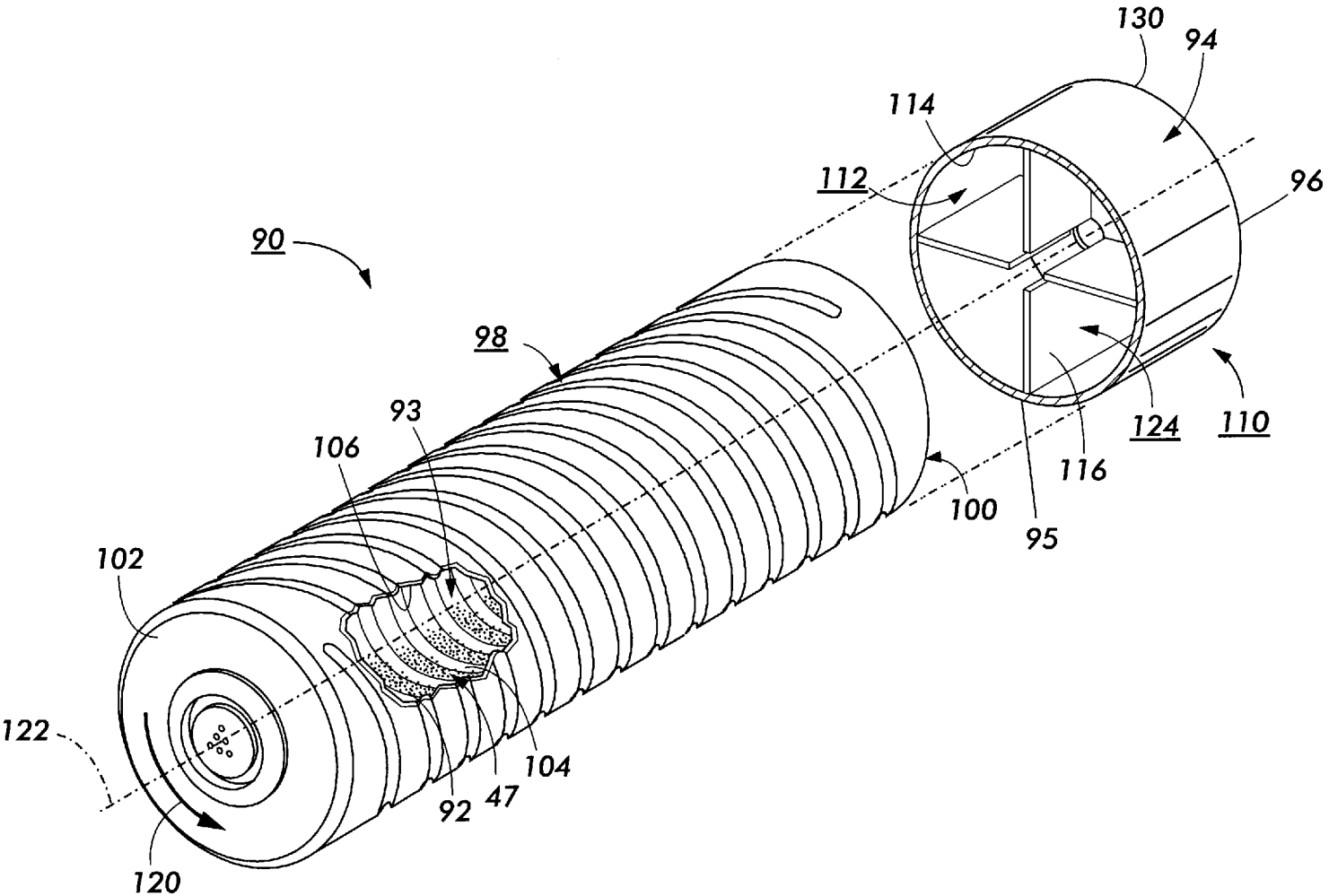
FIG. 3 is an exploded perspective view of the developer material cartridge of FIGS. 1 and 2.

Referring now to FIGS. 1–3, the developer material cartridge 90 is shown in greater detail, and includes a first cylindrical housing 98 defining a developer material containing chamber 93. The first cylindrical housing 98 also defines a first end 100 and a second closed end 102. For urging marking particles 92 out of the housing 98 after installation, the housing portion 98 of the developer material cartridge 90 includes a spiral rib 104 located on an interior periphery 106 thereof. The spiral rib 104 may have either a right hand or a left hand orientation depending on the corresponding rotation of the developer material cartridge 90.

The developer material cartridge 90 also includes a ring shaped portion 110 having a first end 95 that is attached to the first end 100 of the housing portion 98, and a second and opposite end 96 having an opening 94 therethrough into the chamber 93. The ring shaped portion 110 preferably includes radial protrusions 112 therewithin which extend inwardly from an inner periphery 114 thereof, for holding and moving marking particles 92. As such, the radial protrusions 112 each have a carrying face 116 that extends inwardly toward a centerline 122 of the developer material cartridge 90, as shown. The radial protrusions 112 thereby form pockets 124 which become filled with developer material or marking particles 92 discharging from the housing 98.

As further illustrated, the developer material cartridge 90 includes a plate 126 which extends inwardly from a second face 130 of the ring shaped portion 110. The plate 126 includes the first end 96 of the developer material cartridge 90 as well as the opening 94 into the developer material containing chamber 93. The plate 126 preferably includes an interior hub 132 which extends inwardly from the plate 126.

The developer material cartridge 90 as such is used for containing a supply of marking particles 92 within the chamber 93. The marking particles 92 preferably are in the form of an electrostatically attractable powder marking material or toner. In two component development (FIG. 1) the toner or marking particles 92 are added to carrier granules within the sump 45 to form the development material 47. Developer material cartridge 90 has a generally cylindrical shape and an opening 94 located on a first end 96 thereof.

Referring particularly to FIG. 2, the developer material cartridge 90 is shown installed (supported by members 180) in developer unit 38 with centerline 122 of the developer material cartridge 90 in a horizontal orientation. The developer unit 38 as above includes the developer housing 44 from which the cartridge supports 180 extend. A sump housing 184 extends upwardly from one end 186 of the developer housing 44. A machine interface and feed mechanism 190 extends through the sump housing 184 and outwardly therefrom in the direction of centerline 192, centerline 192 being co-linear with centerline 122. The feed mechanism 190 extends through opening 94 of the developer material cartridge 90.

The feed mechanism 190 is in the form of an auger 194 which is located within a tube 144. The tube 144 has an inlet opening 198 in the upper portion of the tube 144 near a first end 200 of the tube 144. The tube 144 also has an outlet opening 202 in the bottom portion of the tube 144 near second end 204 of the tube 144. The developer unit 38 further includes a container drive motor 210 which may be located anywhere within the developer unit 38, but preferably, is secured to the sump housing 184.

The container drive motor 210 serves to rotate the developer material cartridge 90 as well as auger 194. Any suitable gear train may be used to connect the motor 210 to the auger 194 and to the developer material cartridge 90. For example, the motor 210 may have a pinion gear 212 extending inwardly therefrom. A sun gear 214 slidably rotates about tube 144 and meshes with pinion gear 212.

To urge the sun gear 214 against the developer material cartridge 90 and assure the mating of the ramps 216 with pins 172, the developer unit 38 further includes a spring 224 slidably fitted about tube 144 between the sump housing 184 and second face 226 of the sun gear 214. To interconnect the developer material cartridge 90 to the feed mechanism 190, the pins 172 are located on the a face 220 of the sun gear 214 and are aligned adjacent the ramps 216 of the developer material cartridge 90 to cooperate therewith.

Referring again to FIG. 2, to assure that the developer material cartridge 90 is adequately axially positioned relative to the feed mechanism 190, a stop 242 located preferably on developer housing 44 secures the developer material cartridge by restraining closed end 102 of the developer material cartridge 90. A series of gears 244 preferably interconnect drive motor 210 to the auger 194. The gears 244 are so configured that when motor 210 rotates in the direction of arrow 246, the auger 194 will be rotated in a direction to urge the marking particles 92 from the inlet opening 198 to the outlet opening 202.

The developer unit 38 further preferably includes a developer auger 250 extending from bottom 252 of the sump housing 184. The auger 250 is located within conduit 254 and extends outwardly along the length of developer housing 44. The conduit 254 includes one or more dump holes 256 which permit the marking particles 92 to enter the developer housing 44.

Referring now to FIGS. 2–6, the developer material cartridge 90 also includes the robust multiple function seal 300 of the present invention. As illustrated in FIG. 2, the robust multiple function seal 300 is located against a face 138 of a shoulder 139 of an interior hub 132 of the ring portion 110, and is thus contained within the interior hub 132. The robust multiple function seal 300 as located serves to contain the marking particles 92 during installation, during operational dispensing thereof, and during removal of the developer material cartridge 90 from the developer unit 38. The developer material cartridge 90 further includes ramps 216 extending outwardly from first end 96 for interfacing or interconnecting with the developer unit 38.

Figure 4:
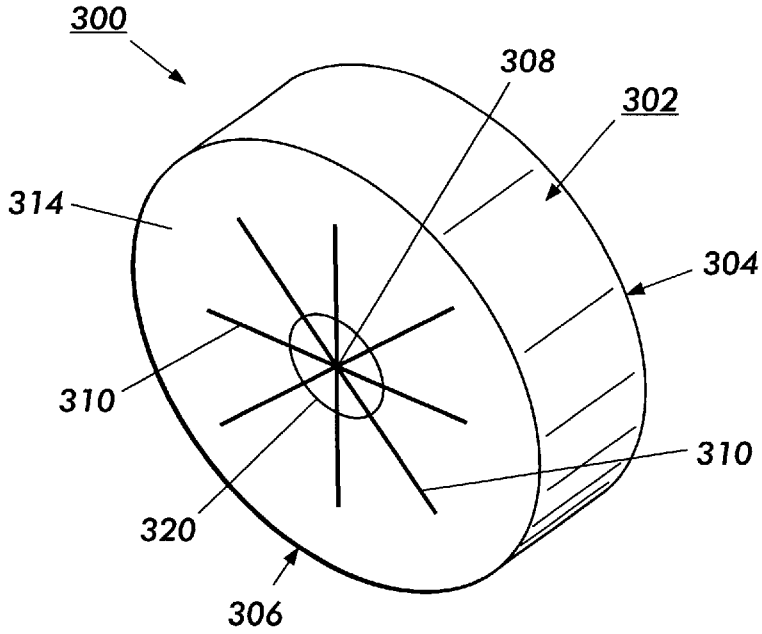
FIGS. 4 and 5 are each a perspective view of the robust multiple function seal of the present invention.
Figure 5:
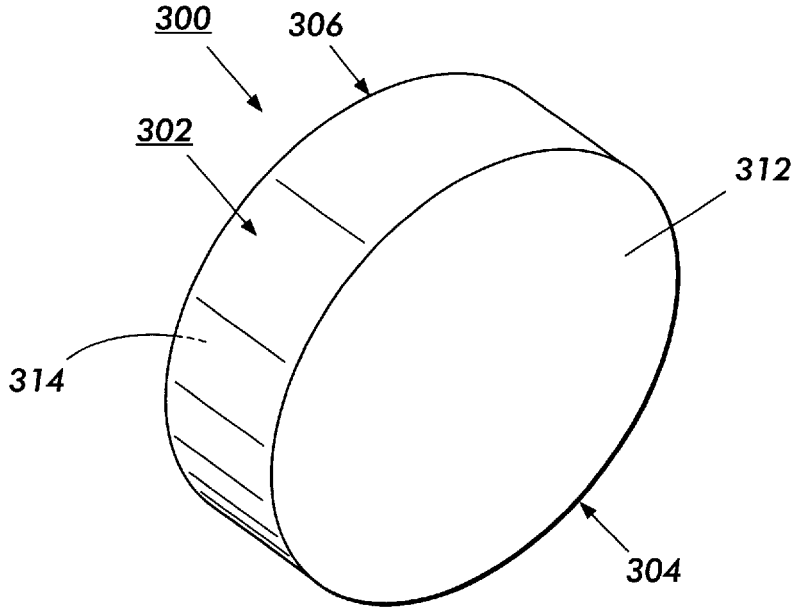
Figure 6:
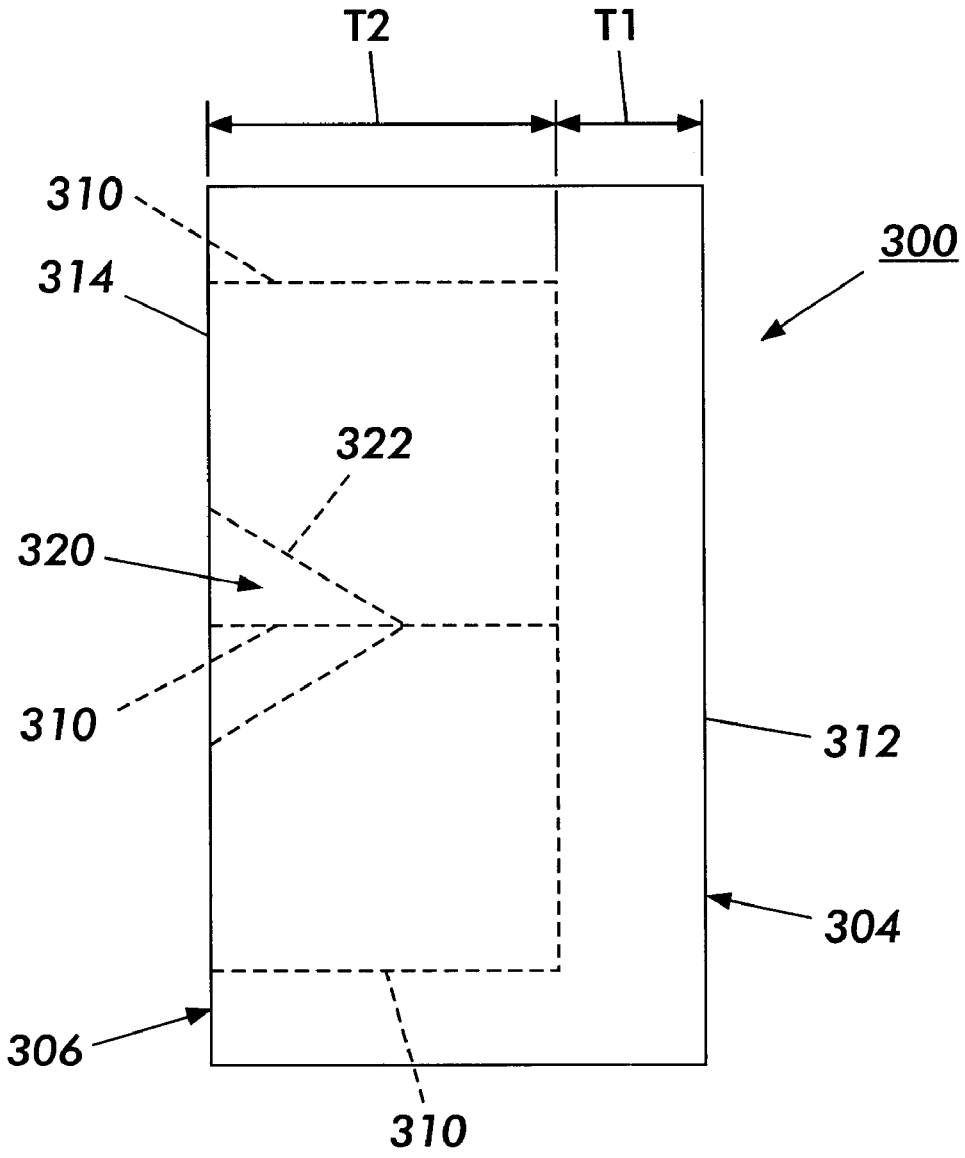
FIG. 6 is a side view of the robust multiple function seal of the present invention.

The robust multiple function seal 300, as shown in more detail in FIGS. 4–6, comprises a single member 302 that includes a solid first end portion 304 for sealing the opening 94 into the developer material containing chamber 93 during shipping and transportation of the cartridge 90. The single member 302 also includes a second end portion 306 that has deep slits 310 cut through it for enabling non-damaging coupling with, as well as puncturing of the solid first end 304 by, the tip 200 of the machine interface member 190, thereby avoiding the undesirable risks of seal damage and developer material spills.

Specifically, the first end portion 304 has a first end surface 312, and the second end portion 306 has a second and opposite end surface 314. As shown, the entire first end portion 304 having a first thickness T1 (FIG. 6) is uncut prior to installation and is thus impermeable to marking particles 92. The same is also true of the first end surface 312 as shown (FIG. 5). As such, the first end portion 304 with end surface 312 is suitable for sealing the opening 94 so as to effectively retain developer material 92 within the cartridge 90 during shipment, installation, and operational dispensing thereof. As further shown, the second end portion 306 adjoins the first end portion 304, and has a second thickness T2, as well as includes the second and opposite end surface 314. The deep slits 310 are cut from the second end surface 314, completely through the second thickness T2, and terminating where the second end portion 306 adjoins the first end portion 304. The robust multiple function seal 300 is assembled to the cartridge 90 such that the second end portion 306 is external relative to the first end portion. This therefore allows the lead end 200 (FIG. 3) of the machine interface 190 to contact the second end portion 306 first and be inserted through it, before contacting and puncturing the first end portion 304.

In order to insure the integrity of the seal 300, it is sized to be robust, and a sufficient number or plurality of the slits 310 are formed through the second end portion as above. The slits preferably are formed so that they criss-cross at a center point 308 of end surface 314. In accordance with a further aspect of the present invention, the robust multiple function seal 300 includes a lead-in recess 320 that is formed from the second and opposite end surface 314 partially into the thickness T2, and about the center point 308 of surface 314. The lead-in recess 320 is defined by a wall 322 that narrows inwardly from the surface 314, thus assuring that the lead end 200 of interface 190 pierces the remainder of the thickness T2, as well as punctures the thickness T1, in the center. As such, lead-in recess 320 further enables non-damaging coupling therewith of the lead end 200 (of the machine interface member 190), during installation, thereby avoiding undesirable risks of seal damage and developer material spills.

The robust multiple function seal 300 as such may be made of any suitable material which is easily pierced, and is very resilient. For example, it can be from a compressible material such as a resilient foam plastic, such as, a polyurethane foam.

As can be seen, there has been provided a developer material cartridge including a robust multiple function seal, for use in a developer unit of an electrostatographic reproduction machine including a machine interface member. The developer material cartridge includes a cylindrical housing defining a developer material containing chamber and an open end into the chamber. The robust multiple function seal comprises a single member including a solid first end for sealing the open end into the developer material containing chamber during shipping and transportation of the cartridge. The single member also includes a partially slit-through second end for enabling non-damaging coupling with, as well as puncturing of the solid first end by, the machine interface member, thereby avoiding the undesirable risks of seal damage and developer material spills.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed:

1. A developer material cartridge for use in a developer unit of an electrostatographic reproduction machine, the developer material cartridge comprising:

(a) a housing defining a developer material containing chamber and an open end into said chamber; and (b) a robust multiple function seal assembled to said open end for retaining developer material within said housing during shipment, installation, and operational dispensing of developer material from said housing, said multiple function seal comprising a single member having a first end surface and a second and opposite end surface, said single member also including:

(i) a first end portion having a first, impermeable, thickness and said first end surface for sealing said open end into said developer material containing chamber during shipment, installation, and operational dispensing of developer material from said housing, (ii) a second end portion adjoining said first end portion, said second end portion having a second thickness including said second and opposite end surface, and a plurality of slits cut through said second and opposite end surface into said second thickness; and (iii) a lead-in recess formed into said second and opposite end surface for enabling non-damaging coupling therewith of a machine interface member during installation, thereby avoiding undesirable risks of seal damage and developer material spills.

2. The developer material cartridge according to claim 1, wherein said slits are cut criss-cross at a center point of said second and opposite end surface, and said lead-in recess is centered on said center point.

3. The developer material cartridge according to claim 1, wherein said slits are cut from said second and opposite end surface completely through said second thickness and ending where said second end portion adjoins said first end portion.

4. The developer material cartridge according to claim 1, wherein said lead-in recess is tapered and narrows inwardly from said second and opposite end surface into said second thickness for guiding the receipt of, and sealing against, the machine interface member.

5. The developer material cartridge according to claim 1, further comprising urging means, comprising a radial protrusion extending inwardly from an internal periphery of said container, for urging marking particles from within said developer material containing chamber toward said open end.

6. A developer material cartridge according to claim 1, wherein said robust multiple function seal comprises a resilient, compressible material.

7. A developer unit for developing a latent image recorded on an image receiving member with a supply of developer material, the developer unit comprising:

(a) a developer housing defining a developer material mixing chamber;

(b) support members attached to said housing for supporting a developer material cartridge relative to said developer material mixing chamber; and (c) a developer material cartridge including a cartridge housing defining an open end and a chamber containing developer material, said developer material cartridge also including a robust multiple function seal assembled to said open end for retaining developer material within said cartridge housing during shipment, installation, and operational dispensing of developer material from said cartridge housing, said multiple function seal comprising a single member having a first end surface and a second and opposite end surface, said single member also including:

(i) a first end portion having a first, impermeable, thickness and said first end surface for sealing said open end into said developer material containing chamber during shipment, installation, and operational dispensing of developer material from said housing, (ii) a second end portion adjoining said first end portion, said second end portion having a second thickness including said second and opposite end surface, and a plurality of slits cut through said second and opposite end surface into said second thickness; and (iii) a lead-in recess formed into said second and opposite end surface for enabling non-damaging coupling therewith of a machine interface member during installation, thereby avoiding undesirable risks of seal damage and developer material spills.

8. A developer unit according to claim 7, further comprising urging means, associated with said container, for urging the marking particles in the chamber toward said open end of said chamber.

9. A developer unit according to claim 7, wherein said robust multiple function seal comprises a resilient, compressible material.

* * * * *